United States Patent [19]

Kritske

[11] 4,431,153

[45] Feb. 14, 1984

[54] ROTARY CAM BRAKE

[75] Inventor: Victor J. Kritske, Sheboygan, Wis.

[73] Assignee: Mayline Company, Inc., Sheboygan, Wis.

[21] Appl. No.: 263,681

[22] Filed: May 14, 1981

[51] Int. Cl.[3] ..... A47F 5/12

[52] U.S. Cl. ..... 248/188.1; 248/454; 108/6

[58] Field of Search ..... 248/188.1, 371, 372.1, 248/454, 122; 108/6; 188/72.7, 72.8; 312/232

[56] References Cited

U.S. PATENT DOCUMENTS

| | | | |
|---|---|---|---|
| 1,443,093 | 1/1923 | Sanderson | 188/72.8 |
| 1,613,541 | 1/1927 | Smith | 188/72.8 |
| 2,197,359 | 4/1940 | Cook et al. | 108/6 |
| 2,622,951 | 12/1952 | Sautereau | 108/6 X |
| 3,140,559 | 7/1964 | Grow et al. | 108/6 |
| 3,206,268 | 9/1965 | Grow et al. | 108/6 X |
| 3,506,097 | 4/1970 | Hollnagel | 188/72.8 |
| 3,638,584 | 2/1972 | Cisler | 108/6 |
| 3,908,561 | 9/1975 | Cowley | 108/6 |
| 4,278,032 | 7/1981 | Kritske | 108/6 |

FOREIGN PATENT DOCUMENTS

| | | | |
|---|---|---|---|
| 734807 | 8/1955 | United Kingdom | 188/72.8 |
| 618101 | 8/1978 | U.S.S.R. | 108/6 |

*Primary Examiner*—William H. Schultz
*Attorney, Agent, or Firm*—Irwin C. Alter

[57] ABSTRACT

Apparatus for locking a drafting board in a desired attitude of angular adjustment enables adjustment of the drafting board through a full ninety degree movement. Force is selectively applied by a control system to interdigitating brake leaves to hold the drafting board surface from rotating once the desired angle has been achieved, and is selectively released to enable angular adjustment. Provision is made to adjust the control system of the apparatus responsive to the particular geometry of the drafting table.

8 Claims, 5 Drawing Figures

3
3
74
35
29
12
14
14a
31a
31
b
45
14a
10

33
58
63
62
19

19
28
57
48
27
50
26a
26
49
25
47
46
22
51
a
13
17
13a
44
22a
20
11
18
15
18
16
13a
34
74

ROTARY CAM BRAKE

The present invention relates generally to drafting tables and, more particularly, to apparatus enabling the angle of tilt of a drafting board to be selectively changed.

It is important to provide drafting tables with a with range of adjustability with respect to the angle at which the drawing surface of the drafting table is maintained. This is because draftsmen differ in selecting angles at which they may work most comfortably, and given the long hours necessary to complete most drawings, comfort is a very important factor.

Another factor to consider is adjustment of the board during various phases of drawing wherein one angle may be most comfortable for a portion of the work and another angle may prove to be more comfortable for the balance of the work. Too, there is the situation where more than one draftsman utilizes the same drafting board, requiring not only that changes in the tilt of the board be possible, but that such changes be accomplished in as simple, straight-forward, and reliable a fashion as possible.

One approach to the solution of this problem may be seen in my copending application Ser. No. 44,930, now U.S. Pat. No. 4,278,032, wherein a selectively engageable and disengageable rotary brake is utilized in order to allow the angle of tilt of a drafting surface to be changed. Differing drafting table configurations, geometry, and materials of construction make other means for the adjustment of the angle of tilt desirable as well, and one such additional means is the subject of the present specification.

It may be desirable to have the means by which the drafting table is held at a particular angle to have adjustable controls utilizable to engage at both ends of the mechanism supporting the table. It is also advantageous to have the control which selectively releases and reengages the holding mechanism be adjustable throughout a selectable range so that the controls for the mechanism may be individually adjusted for the particular ease and comfort of the draftsman involved, and to allow for the particular geometry of the table used.

The present invention has, therefore, the following objects:

To provide apparatus to hold a drafting table surface at a selected attitude of tilt;

To provide such apparatus in forms which are simple and reliable in use;

To provide such apparatus in forms making the adjustment of the angle of tilt a simple procedure;

To provide such apparatus with controls which may be adjusted for the particular drafting table structure utilized and the comfort of the draftsman;

To provide such apparatus in forms whereby the force required to hold the board in position is exertable by a single control;

To provide such apparatus in forms whereby the force applied to hold the drafting surface in position is applied at more than one site; and To provide such apparatus in forms both simple and economical to manufacture and maintain.

These and further objects will become more apparent upon consideration of the accompanying drawings wherein.

Figures 1, 5:
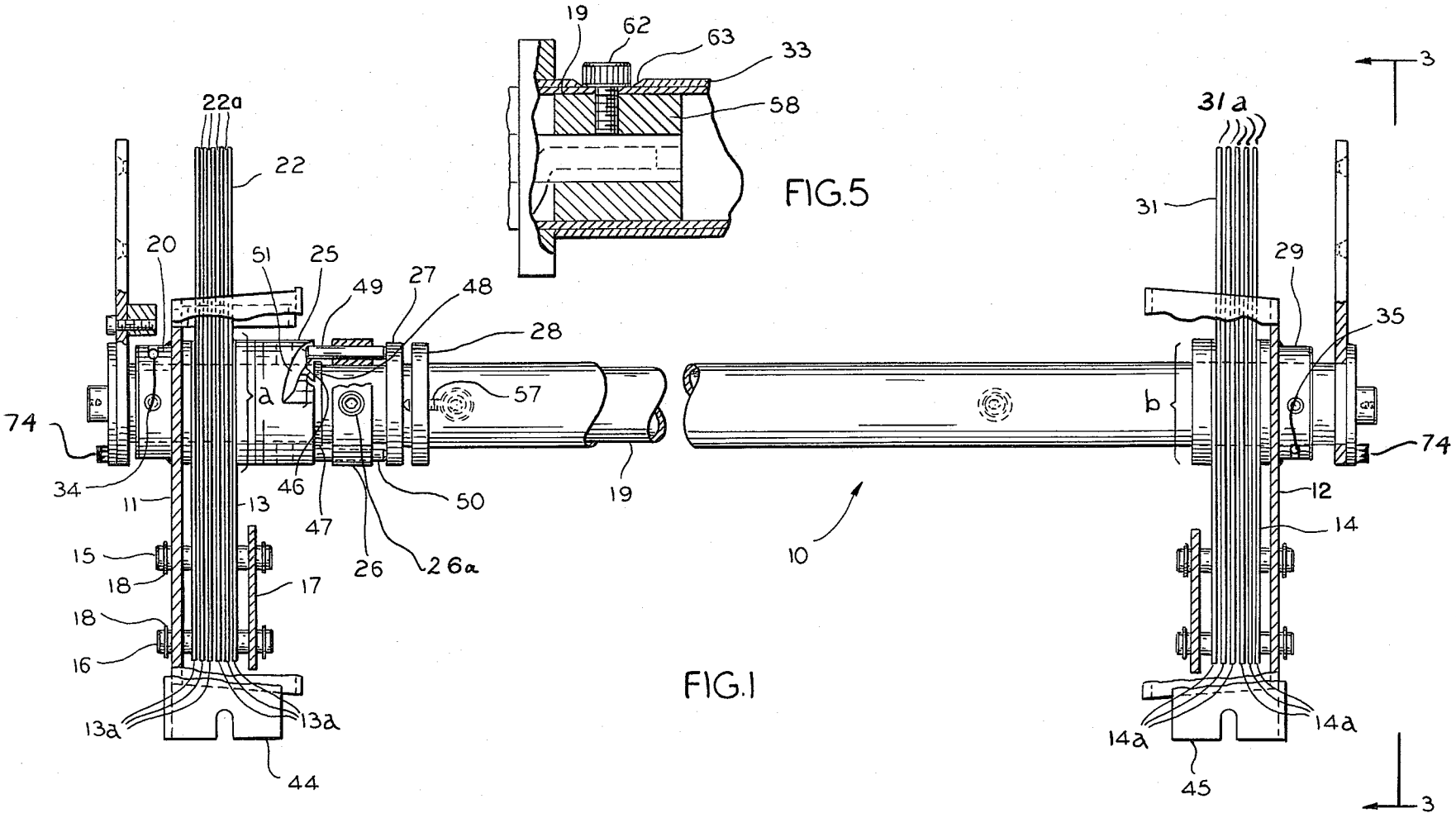
FIG. 1 is a top view of the subject invention.
FIG. 5 is a partial back sectional view.

Referring now to FIG. 1, the numeral 10 indicates generally an adjusting mechanism for a drafting table. The drawing surface itself may, as an example, be attached to tilt brackets 11 and 12 via screws, bolts, or other suitably selected fasteners.

Tilt brackets 11 and 12 have attached thereto brake leaf assemblies as herein shown at 13 and 14, respectively. For purposes of this preferred embodiment, said brake leaf assemblies may be characterized as a plurality of flat rectangular plates 13*a* and 14*a*, arranged such that such individual plate is spaced slightly apart from its immediately adjacent neighbors.

As typified by the left hand portion of FIG. 1, brake leaf assembly 13 is attached, via brake leaf pins 15 and 16, and brake leaf pin bracket 17 to tilt bracket 11 at 18. A similar construction, with corresponding structure, may be employed for bracket 12 and brake leaf assembly 14.

Figures 2, 4:
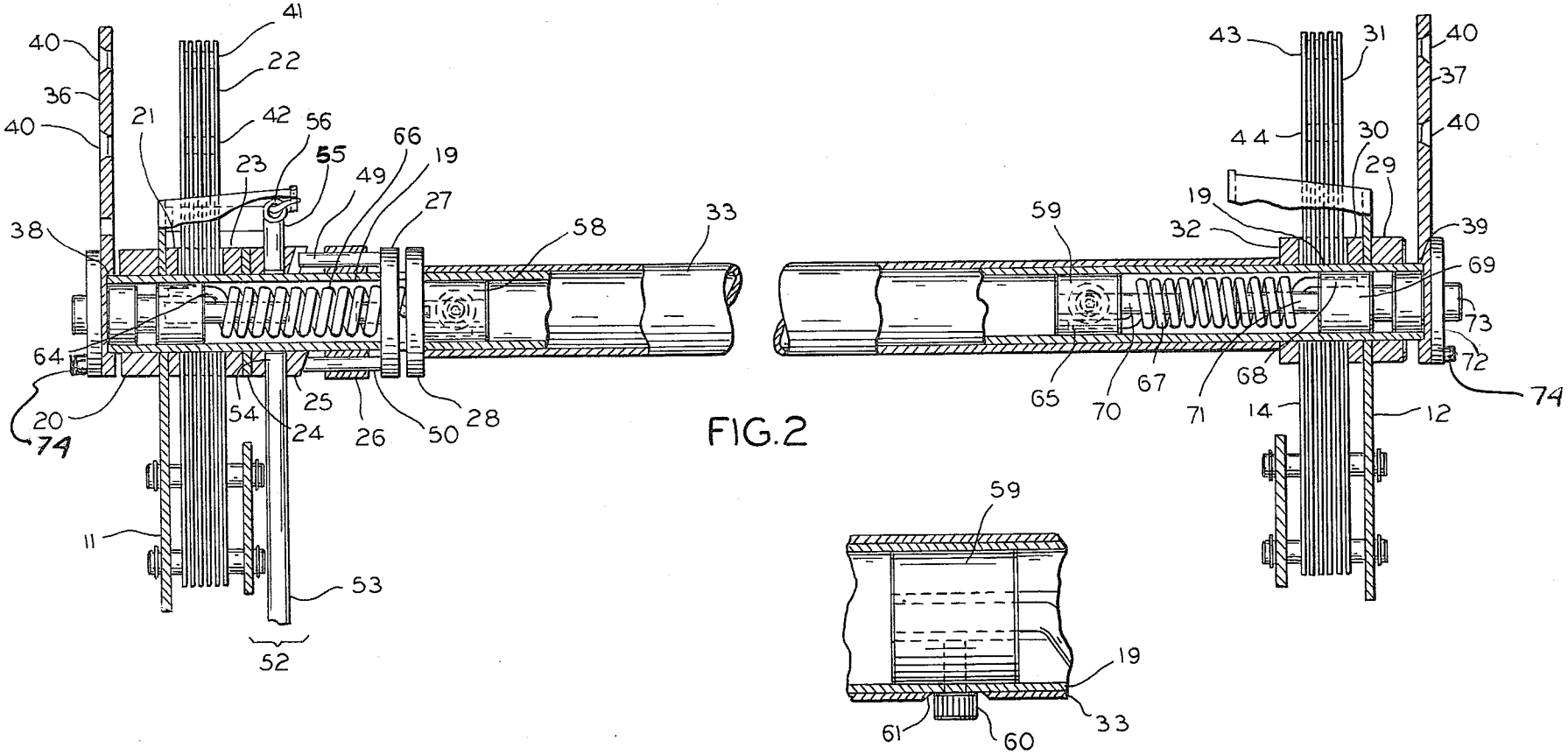
FIG. 2 is a top view in section of the subject invention.
FIG. 4 is a partial back view.

As seen in FIG. 2, tilt bracket 11 is attached to spring tube 19, enabling tilt bracket 11 and brake leaf assembly 13 to be rotated with spring tube 19. For this reason, reference will be had to brake leaf assemblies 13 and 14 as *moveable* brake leaf assemblies, for reasons which will become more apparent hereinafter. In like fashion, moveable brake leaf assemblies 13 and 14 are rotatably mounted upon spring tube 19. It is the rotation of spring tube 19 which enables the adjustment of the angle of tilt of the drawing board surface attached to tilt brackets 11 and 12.

Referring now to FIG. 2, and more particularly to the left hand portion thereof, mounted concentrically about spring tube 19 are first split collar 20, tilt bracket 11, first spacer washer 21, moveable brake leaf assembly 13, stationary brake leaf assembly 22, pressure washer 23, brake leaf spacer 24, brake cam 25, pressure pin collar 26, pressure washer 27, and adjusting screw washer 28. With respect to the right hand portion of FIG. 2, the following structure is found. Second split collar 29, tilt bracket 12, second spacer washer 30, moveable brake leaf assembly 14, stationary brake leaf assembly 31, and second pressure washer 32. Extending concentrically about spring tube 19 between adjusting screw washer 28 and second pressure washer 32 is pusher tube 33.

Figure 3:
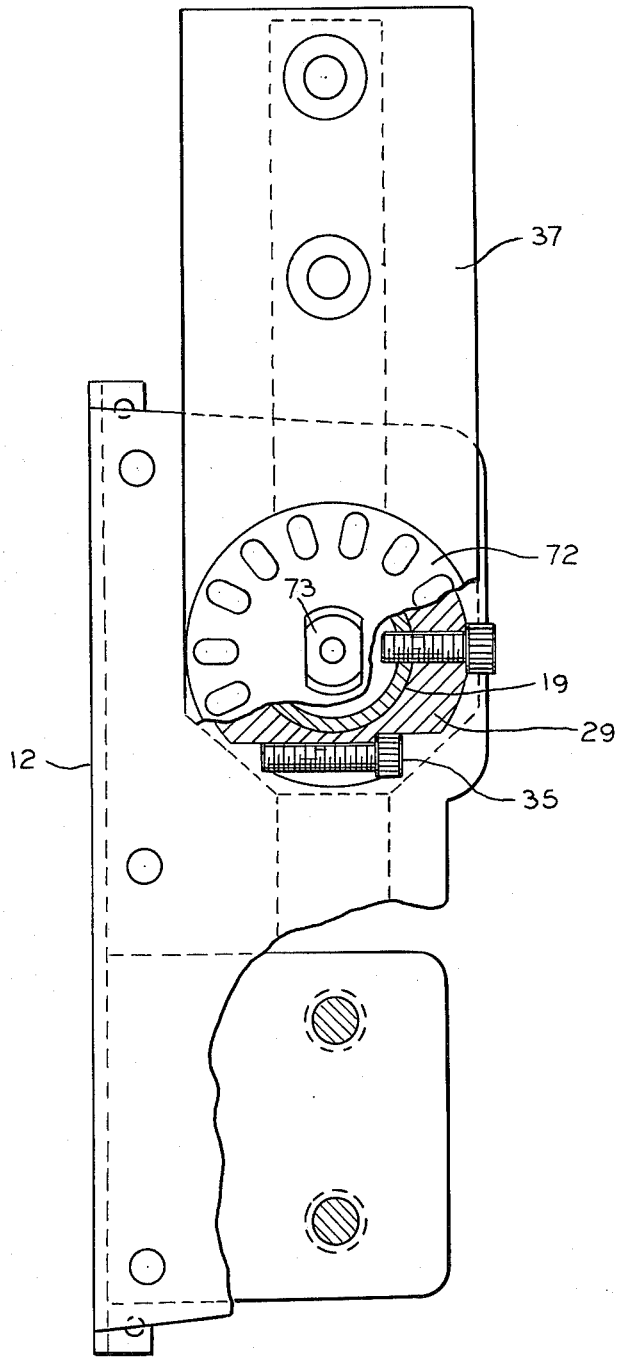
FIG. 3 is an end view of the right end of the apparatus shown in FIG. 1.

First and second split collars 20 and 29 are clamped to spring tube 19 by threaded fasteners 34 and 35, respectively, as seen in FIGS. 1 and 3. In this fashion, split collars 20 and 29 retain the individual structural elements hereinabove described in their relative positions on spring tube 19. Pressure pin collar 26 is secured to spring tube 19 by fastener 26*a*, as seen in FIG. 1.

Each stationary brake leaf assembly 22 and 31 is characterized generally by individual plates such as 22*a* and 31*a*, similar in shape and construction to plates 13*a* and 14*a*, and similarly spaced apart.

Moveable brake leaf assemblies 13 and 14, respectively, are positioned to interdigitate with stationary leaf assemblies 22 31, respectively, in the areas indicated with the letters a and b as seen in FIG. 1.

Brake leaf assemblies 22 and 31 are referred to herein as "stationary" brake leaf assemblies because they are held in a fixed position with respect to, respectively, moveable brake leaf assemblies 13 and 14. This is accomplished in the following fashion.

As best seen in FIG. 2, tilt extension plates 36 and 37 rotatably support spring tube 19 at sockets 38 and 39, respectively. Each such tilt extension plate is secured to whatever structure is utilized to support the entire drafting assembly as, for example, legs, brackets extending to a cabinet, or the like.

To facilitate such attachment, each tilt extension plate has apertures formed therethrough such as typified by the numeral 40. In addition, stationary brake leaf assemblies 22 and 31 each have a series of concentric apertures formed therethrough, shown, respectively at 41, 42, 43, and 44 of FIG. 2. Said apertures are positioned to align with apertures 40. A fastening element, such as a screw, bolt, or the like, may then be passed through each aperture 40 and, correspondingly, through stationary brake leaf assembly apertures 41, 42, 43, and 44. In this fashion, while spring tube 19 is rotatable in tilt extension plates 36 and 37, stationary brake leaf assemblies 22 and 31 will be held in non-rotatable association with said tilt extension plates.

As best seen in FIG. 1, stationary brake leaf assembly 22 and moveable brake leaf assembly 13 interdigitate in the area indicated by the letter a, while stationary brake leaf assembly 31 and moveable brake leaf assembly 14 interdigitate throughout a similar area indicated by the letter b. In the operation of apparatus 10, spring tube 19 will be free to rotate when interdigitated brake leaf assemblies 13 and 22 and 14 and 31 are not pressed together at, respectively, areas a and b. When pressure is applied in the aforesaid areas, spring tube 19 will not rotate, and will be held in a desired attitude of rotation and will thereby support a planar surface, such as a drafting board, in a desired attitude of tilt. As an example, a drafting board may be attached to board brackets 44 and 45, which are attached to tilt brackets 11 as shown in FIG. 1.

Engaging and disengaging the left and right hand brake leaf assemblies may be accomplished, in a preferred embodiment, in the following manner. Brake cam 25, as best seen in FIG. 1, has insert 46 formed therein. Insert 46 is machined into brake cam 25 beginning at the right hand edge 47 thereof and inclining inward at an angle of approximately 18 degrees, an angle which has proven to provide satisfactory performance in the operation of mechanism 10. Brake cam 25 rides on brake cam bearing 48 positioned concentrically about spring tube 19.

As best seen in FIGS. 1 and 2, pressure pin collar 26 is positioned proximate brake cam 25, and has a pair of hardened steel dowels 49 and 50 therethrough extending toward brake cam 25. In a preferred embodiment, it is contemplated that a pair of inserts such as that illustrated at 46 are milled into brake cam 25, and dowels 49 and 50 are positioned on pressure pin collar 26 to register with said inserts.

The remaining ends of dowels 49 and 50 extend toward pressure washer 27.

When brake cam 25 is rotated about spring tube 19, such rotation results in contact between, for example, dowel 49 and portions of machined inclined surface 51 of insert 46. In the example shown in FIG. 1, brake cam 25 is rotated to bring dowel 49 into contact with a portion of incline surface 51 which is proximate to face 47 of brake cam 25. At the same time, dowel 50 is contacting a similar portion of a similar insert not herein specifically shown. Such rotation has the effect of moving pressure pin collar 26 to the right, thereby moving pressure washer 27 to the right as well.

As seen in FIG. 2, such rotation of brake cam 25 thereupon results in the following sequence. Dowels 49 and 50 are contacted by brake cam 25 and are moved toward the right, thereby forcing pressure washer 27 into contact with adjusting screw washer 28. Adjusting screw washer 28 thereupon contacts pusher tube 33 which contacts pressure washer 32 and the interdigitated portion b of brake leaf assemblies 14 and 31. Force is then applied to spacer washer 30 and, ultimately, to split collar 29. When this limit of travel has been reached, brake cam 25 is thereby urged to the left as rotation of said brake cam continues, contacting spacer 24, pressure washer 23, and the interdigitated segment a of brake leaf assemblies 13 and 22. Such force continues to be exerted against spacer washer 21 and ultimately split collar 20.

Pusher tube 33 is dimensioned such that, when brake cam 25 is rotated to its release position (that is, the position in which dowels 49 and 50 are contacted with the least force), all of the elements described in the foregoing sequence are in physical contact without sufficient force to clamp interdigitated brake leaf assemblies 13, 22, 14 and 31 to prevent rotation of spring tube 19. As brake cam 25 is rotated to a lock position (in the present example, in a counterclockwise position when mechanism 10 is viewed from the right), dowels 49 and 50 are contacted to create increasing force until the above-described brake leaf assemblies are compressed with sufficient force to hold spring tube 19 from further rotation.

To effect such controlled rotation of brake cam 25, control lever assembly 52 may be employed, as seen in FIG. 2.

Control assembly 52 includes lower control rod 53 mounted to brake cam 25 at 54. An upper control rod segment 55 extends from the opposite side of brake cam 25, and control spring 56 extends from the end of upper control rod segment 55 to a solid point of anchor. In this instance, as an example, the anchoring point may be tilt bracket 11.

In the present example, attachment of upper control rod segment 55 to control spring 56 is accomplished in such a manner that brake cam 25 is normally urged to its stressed position, that is the position in which the interdigitated brake leaf assemblies are held with sufficient force to prevent rotation of spring tube 19. In such an arrangement, release of mechanism 10 is accomplished by moving lower control rod 53 to rotate brake cam 25 in a clockwise direction as viewed from the right. When lower control rod 53 is released, the mechanism returns to its locked position.

Operation of lower control rod 53, in the example herein illustrated, means that the rod is moved upward or toward the lower surface of the drafting board in order to release the drafting board to be tilted to a new angle. With such an arrangement, it is desirable to provide a degree of adjustability in the arc of travel traversed by the lower control rod 53. The rod must move through an arc sufficient to release spring tube 19 for adjustment and thereafter securely hold spring tube 19 against rotation when the drafting board is being used.

The presently described embodiment of my invention provides for the adjustability of lower control rod 53 as follows. Adjusting screw washer 28, as seen in FIG. 1, has a pair of set screws 57 threaded therethrough to contact pressure washer 27. Only one such set screw is seen in FIG. 1 and it is to be understood that a second screw is positioned diametrically opposite said screw 57. As set screws 57 are threaded toward pressure washer 27, greater force is exerted on the interdigitating brake leaf assemblies described hereinabove. As a consequence, brake cam 25 need be rotated through a shorter arc in order to contact dowel 49 and 50 with sufficient force to prevent spring tube 19 from rotating, and the "rest", or lock position of control cam 25 will be changed. In like fashion, should set screws 57 be threaded outwardly away from pressure washer 27, the segment through which brake cam 25 need be rotated will increase and, consequently, the arc through which lower control rod 53 must be rotated will also increase.

As best seen in FIG. 3, split ring washer 29 is held to spring tube 19 by the tightening of screw 35. In like fashion, split collar 20 is held to the left end of assembly 10 by screw 34.

In order to counter-balance the drafting board utilized with the presently described assembly, spring tube 19 has positioned therewithin spring torsion blocks 58 and 59 as seen in FIG. 2. FIG. 4 illustrates the anchoring of one such torsion block 59 with bolt 60. As is seen in FIG. 4, pusher tube 33 is provided with a window 61 through which bolt 60 may pass with sufficient clearance to allow sufficient movement of pusher tube 33 in order to engage and disengage the interdigitating brake leaf assemblies.

FIG. 5 illustrates a sectional view of the attachment of one such torsion block 58, the securing of said torsion block by bolt 62, and the corresponding window 63 formed through pusher tube 33.

Each torsion block 58 and 59 is provided with a groove which receives ends 64 and 65 of torsion springs 66 and 67 respectively. Using torsion spring 67 as an example, the remaining end thereof 68 is maintained in torsion adjusting nut 69. Torsion spring guides 70 and 71 extend, respectively, from torsion block 59 and torsion adjusting nut 69.

Torsion adjusting nut 69 is welded to torsion index plate 72 and torsion index plate 72 is secured to tilt extension plate 37 by bolt 74. Thus, when spring tube 19 is rotated, torsion block 59 rotates therewith while torsion nut 69 remains fixed thereby twisting spring 67 which exerts a counter-balancing effect.

While the foregoing has presented a preferred embodiment of the invention, it is to be understood that said embodiment is presented by way of example only. It is expected that others skilled in the art will perceive differences which, while varying from the foregoing, do not depart from the spirit and scope of the claims and description of the invention herein set forth.

I claim:

1. Apparatus for adjustably supporting a drafting board, said apparatus comprising:

a main shaft having first and second ends;

at least two support brackets, said support brackets supporting said main shaft and allowing said main shaft to rotate with respect to said brackets;

at least two brake assemblies, one said brake assembly positioned proximate each said support bracket, each said brake assembly including first and second sets of interdigitated brake leaves;

at least two tilt bracket assemblies, each said bracket assembly rotatably mounted on said main shaft and providing attachment points for said drafting board;

each said first set of brake leaves secured to one said support bracket, each said second set of brake leaves secured to one said tilt bracket assembly;

said second set of brake leaves, and said drafting board brackets being thereby rotatable with respect to said first set of brake leaves and said support brackets;

means to selectively transmit force to said brake assemblies to compress said interdigitated brake leaves together, said force transmission means including a control cam positioned concentrically about said main shaft intermediate said brake assemblies, said control cam having at least one inclined surface formed thereon;

a first collar positioned concentrically on said main shaft intermediate said control cam and said first brake assembly, said first collar having at least one dowel passing therethrough, said first collar attached to said main shaft to position each said dowel proximate to one said inclined cam surface;

tubular means positioned concentrically about said main shaft extending from said first collar to said first brake assembly;

means positioned concentrically about said main shaft extending from said control cam to said second brake assembly;

means anchoring said first and second brake assemblies on said main shaft; and control means, said control means adapted to rotate said control cam on said main shaft to bring one said dowel into contact with each said inclined surface of said control cam to thereby transmit sufficient force to said brake assemblies to compress said first and second sets of interdigitated brake leaves together to prevent rotation of said board brackets with respect to said support brackets, said control means including means to adjust the distance through which said control means must be moved in order to release said compressive force.

2. The apparatus as recited in claim 1 wherein said control adjusting means includes first and second pressure washers positioned intermediate said first collar and said tubular means, said first pressure washer contacting each said dowel; and means to adjustably space said first and second pressure washers apart from one another, thereby altering the contact of said control cam with each said dowel.

3. The apparatus as recited in claim 2 wherein one said pressure washer has at least two threaded apertures formed therethrough, a set screw threaded into each aperture, each said set screw being extendable to contact the remaining said pressure washer.

4. The apparatus as recited in claim 1 wherein said control cam has two said inclined surfaces formed thereon;

said first collar has two said dowel pins passing therethrough, said control cam and said first collar positioned on said shaft to register each said dowel pin with one said inclined surface.

5. The apparatus as recited in claim 1 wherein said control means includes a control rod, said control rod attached to said control cam, said control cam being rotated when said control rod is raised or lowered.

6. The apparatus as recited in claim 1 wherein said control cam is rotatable from a first position toward a second position, said dowels being contacted with progressively more force by reason of said inclined surfaces as said control cam is rotated toward said second position; and said control means includes means to urge said control cam from said first position to a rest position;

said rest position intermediate said first position and said second position.

7. The apparatus as recited in claim 6 wherein said urging means includes a spring, said spring attached at one end to said control cam and anchored at its other end, said spring contracting to rotate said control cam to said rest position.

8. The apparatus as recited in claim 6 wherein said rest position may be altered by said control adjusting means.

* * * * *

UNITED STATES PATENT AND TRADEMARK OFFICE

CERTIFICATE OF CORRECTION

PATENT NO. : 4,431,153

DATED : February 14, 1984

INVENTOR(S) : VICTOR J. KRITSKE

It is certified that error appears in the above-identified patent and that said Letters Patent are hereby corrected as shown below:

Col. 1, line 8: "with" (2nd occurrence) should be -- wide --

Col. 1, line 35: Insert --Other examples of drafting table adjusting mechanisms may be seen in United States Patent Nos. 3,140,559 and 3,206,268.--

Col. 2, lines 16 & 17: "arranged such that such" should be --arranged such that each--.

Signed and Sealed this

Ninth Day of October 1984

[SEAL]

*Attest:*

*Attesting Officer*

GERALD J. MOSSINGHOFF

*Commissioner of Patents and Trademarks*